US009056035B2

(12) United States Patent
Ju et al.

(10) Patent No.: US 9,056,035 B2
(45) Date of Patent: Jun. 16, 2015

(54) MANUAL TRACTOR ASSEMBLY FOR TRACKING WHEEL CHAIR

(71) Applicant: Cycling & Health Tech Industry R&D Center, Taichung (TW)

(72) Inventors: Shun-Yuan Ju, Taichung (TW); Gang-Hua Lee, Taichung (TW); Zheng-Yang Hu, Taichung (TW)

(73) Assignee: Cycling & Health Tech Industry R&D Center, Taichung (TW)

( * ) Notice: Subject to any disclaimer, the term of this patent is extended or adjusted under 35 U.S.C. 154(b) by 113 days.

(21) Appl. No.: 14/024,653

(22) Filed: Sep. 12, 2013

(65) Prior Publication Data

US 2015/0069733 A1 Mar. 12, 2015

(51) Int. Cl.
*A61G 5/02* (2006.01)

(52) U.S. Cl.
CPC ..... *A61G 5/027* (2013.01); *A61G 5/026* (2013.01)

(58) Field of Classification Search
CPC ..... A61G 5/026; A61G 5/027
See application file for complete search history.

(56) References Cited

U.S. PATENT DOCUMENTS 3,381,973 A * 5/1968 Carr ..... 280/30
4,316,616 A * 2/1982 Boivin ..... 280/304.1
4,471,972 A * 9/1984 Young ..... 280/304.1
4,720,117 A * 1/1988 Hay ..... 280/250
4,824,132 A * 4/1989 Moore ..... 280/304.1
5,066,032 A * 11/1991 Van Vooren et al. ..... 280/304.1
5,280,937 A * 1/1994 Needham ..... 280/259
5,501,480 A * 3/1996 Ordelman et al. ..... 280/304.1
5,727,809 A * 3/1998 Ordelman et al. ..... 280/650
5,873,589 A * 2/1999 Hallett ..... 280/250.1
5,899,476 A * 5/1999 Noyola ..... 280/250.1
6,669,222 B1 * 12/2003 Barrett et al. ..... 280/304.1
2004/0251655 A1 * 12/2004 Lindsay et al. ..... 280/282
2006/0226628 A1 * 10/2006 Lindsay et al. ..... 280/250
2011/0121535 A1 * 5/2011 Fremgen et al. ..... 280/250.1
2015/0028558 A1 * 1/2015 Hartman et al. ..... 280/250

* cited by examiner

*Primary Examiner* — Kevin Hurley
*Assistant Examiner* — Gabriela C Craciun
(74) *Attorney, Agent, or Firm* — WPAT, P.C.; Anthony King

(57) ABSTRACT

A tractor assembly includes a connection unit which is connected between the tractor and the wheel chair. The connection unit includes a fixing member, a top link unit, a bottom link unit and a swing rod so as to form a four-link mechanism. The connection unit includes an engaging unit with an engaging section, and a position unit. The top link unit has a reception hole and the positioning unit has a push rod. When the push rod is located at the first position, the reception hole is closed. When the push rod is located at the second position, the push rod is retracted and the reception hole is exposed. The bottom link unit is pivoted about one end of the swing rod to move the other end of the swing rod to the position of the reception hole, the engaging section is inserted into the reception hole.

10 Claims, 9 Drawing Sheets

MANUAL TRACTOR ASSEMBLY FOR TRACKING WHEEL CHAIR

FIELD OF THE INVENTION

The present invention relates to a tractor assembly, and more particularly, to a manual tractor assembly connected with a wheel chair which is moved by operation of the tractor assembly.

BACKGROUND OF THE INVENTION

The conventional tractor assembly is designed to be operated and to move the wheel chair by the disable person sitting in the wheel chair. The tractor assembly is compact and easily connected to the wheel chair. However, the conventional tractor assemblies usually are heavy and take a lot of steps to be connected to or dis-connected from the wheel chair. Some of the conventional tractor assemblies are not stable.

The conventional tractor assemblies usually require a special designed device to be connected to the wheel chair before the tractor assembly is able to be connected to the wheel chair, and the special designed device increases the weight of the whole assembly and involves extra assembling steps. Besides, the special designed device cannot be automatically connected to the wheel chair, so that the disable person has to ask for assistance when connecting or dis-connecting the tractor assembly. In addition, the conventional tractor assemblies are expensive so that most of the disable persons cannot afford the tractor assembly. Although the conventional tractor assemblies have support legs so that the tractor assembly can be installed and assembled in the upright position, however, the hanger brackets of the wheel chair have to be removed before installing the tractor assembly to the wheel chair.

SUMMARY OF THE INVENTION

The present invention relates to a tractor assembly for a wheel chair and comprises a connection unit which is connected between the tractor and the wheel chair, and the connection unit includes a fixing member, a top link unit, a bottom link unit and a swing rod so as to form a four-link mechanism. The connection unit further includes an engaging unit and a position unit, the engaging unit has an engaging section. The top link unit has a reception hole and the positioning unit has a push rod. When the push rod is located at the first position, the reception hole is closed. When the push rod is located at the second position, the push rod is retracted and the reception hole is exposed. When the bottom link unit is pivoted about one end of the swing rod to move the other end of the swing rod to the reception hole, the engaging section is inserted into the reception hole. By the four-link mechanism, the wheel chair is lifted to a pre-set angle so that the user can assemble or dis-assemble the tractor relative to the wheel chair.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
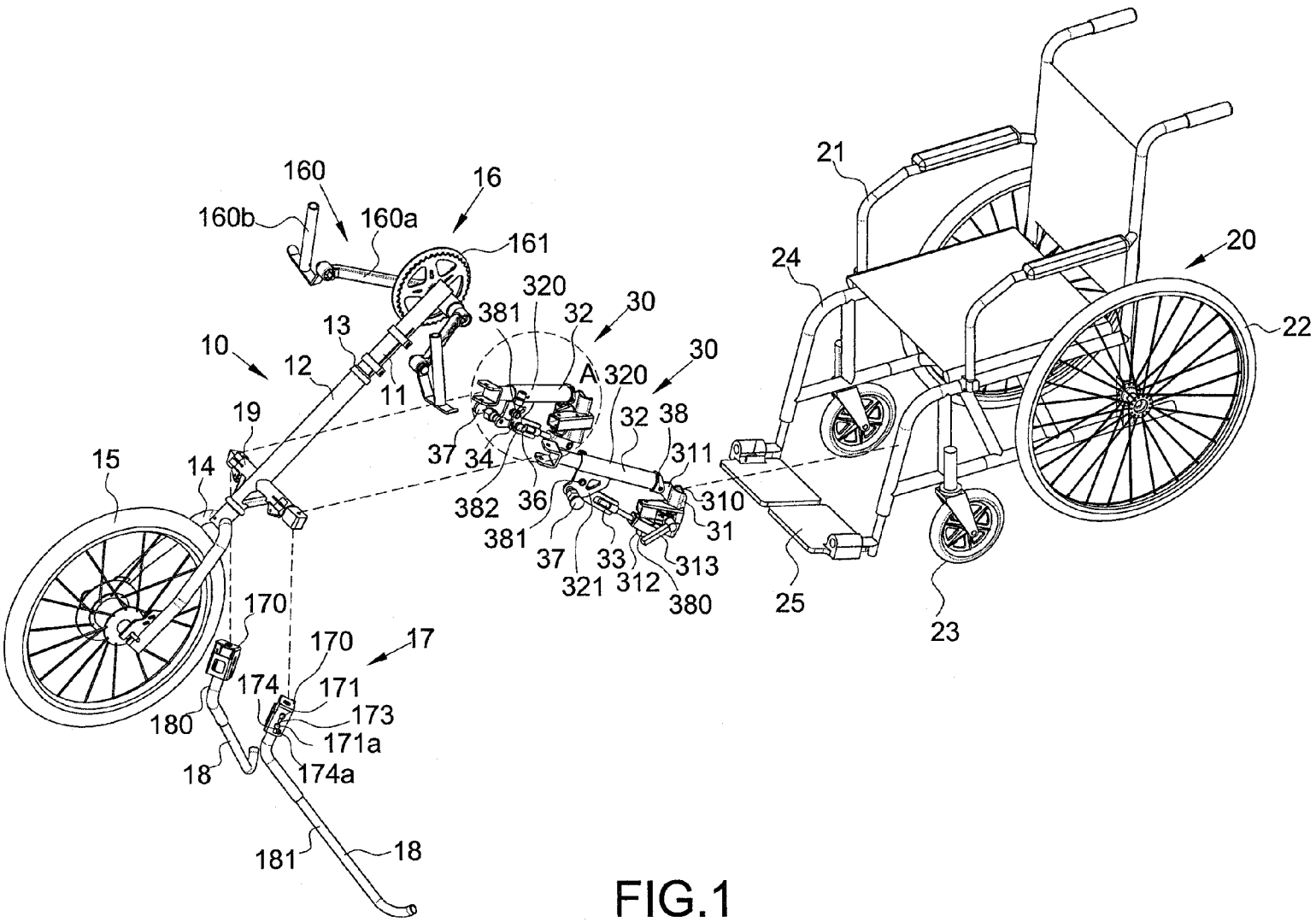
FIG. 1 is an exploded view to show the tractor assembly of the present invention.

Referring to FIGS. 1 to 4, the tractor assembly of the present invention comprises a tractor 10, a rear part 20, and a connection unit 30 connected between the tractor 10 and the rear part 20. The connection unit 30 comprises a fixing member 31, a top link unit 32, a bottom link unit 33, a swing rod 34, an engaging unit 36 and a positioning unit 37. The fixing member 31 has a securing portion 310 on one side of the middle section thereof so as to be connected to the front end of the rear part 20. The fixing member 31 has a first pivotal portion 311 and a second pivotal portion 312 on the other side thereof, wherein the second pivotal portion 312 is located below the first pivotal portion 311. The top link unit 32 has a first end pivotably connected to the first pivotal portion 311 by a first pivot 38, and a second end of the top link unit 32 is connected to the tractor 10. The top link unit 32 comprises a top link 320 and a connection plate 321 which is integrally formed with the top link 320. The top link 320 has the first end thereof pivotably connected to the first pivotal portion 311 by the first pivot 38, and the second end of the top link 320 is connected to the tractor 10, the top link 320 cannot be pivoted relative to the tractor 10 along the vertical surface. The connection plate 321 has a reception hole 322.

The bottom link unit 33 has a first pivotably connected to the second pivotal portion 312 by a second pivot 380 extending therethrough. The swing rod 34 has a first end pivotably connected to the connection plate 321 of the top link unit 32 by a third pivot 381, and a second end of the swing rod 34 is pivotably connected to a second end of the bottom link unit 33 by a fourth pivot 382, so that the swing rod 34, the fixing member 31, the top link unit 32 and the bottom link unit 33 form a four-link mechanism.

The engaging unit 36 is located in the fourth pivot 382 and comprises an engaging section 360 and a second resilient member 361 which provides a resilient force to the engaging section 360. The positioning unit 37 is located on an outside of the connection plate 321 of the top link unit 32 and has a push rod 370 and a third resilient member 372 which provides a force to return the push rod 370. When the push rod 370 returns by the force from the third resilient member 372, the distal end of the push rod 370 are removed from the reception hole 322 so that the reception hole 322 is exposed. When the four-link mechanism is activated to lift the rear part 20 an angle, the swing rod 34 swings about the third pivot 381 by a first angle relative to the connection plate 321, the push rod 370 is located to be aligned with the reception hole 322. The engaging section 360 is pushed by the resilient force from the second resilient member 361 and inserted into the reception hole 322 to secure the four-link mechanism.

Figure 2:
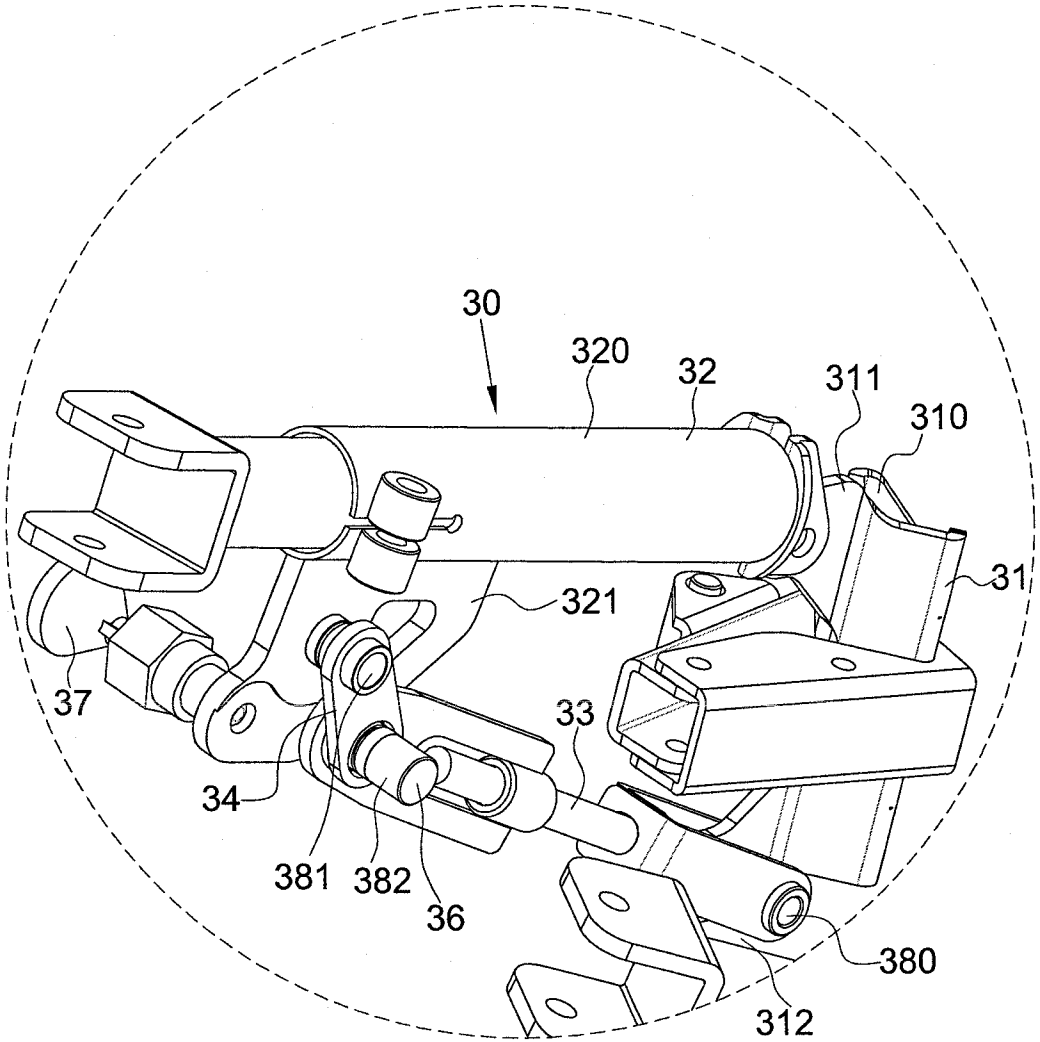
FIG. 2 is a perspective view to show the connection unit of the tractor assembly of the present invention.
Figure 3:
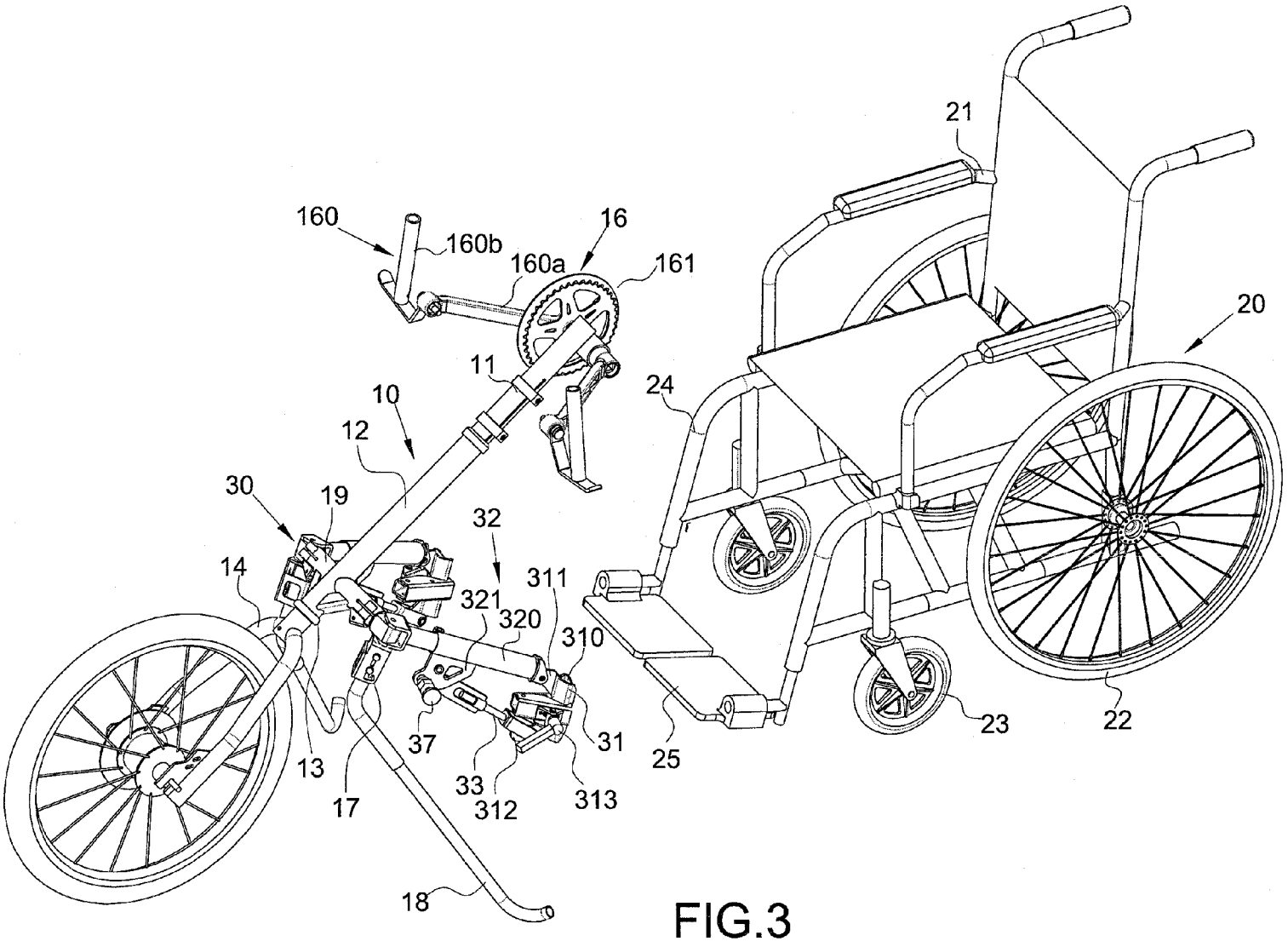
FIG. 3 is a perspective view to show that the tractor assembly is not yet connected to the wheel chair.
Figure 4:
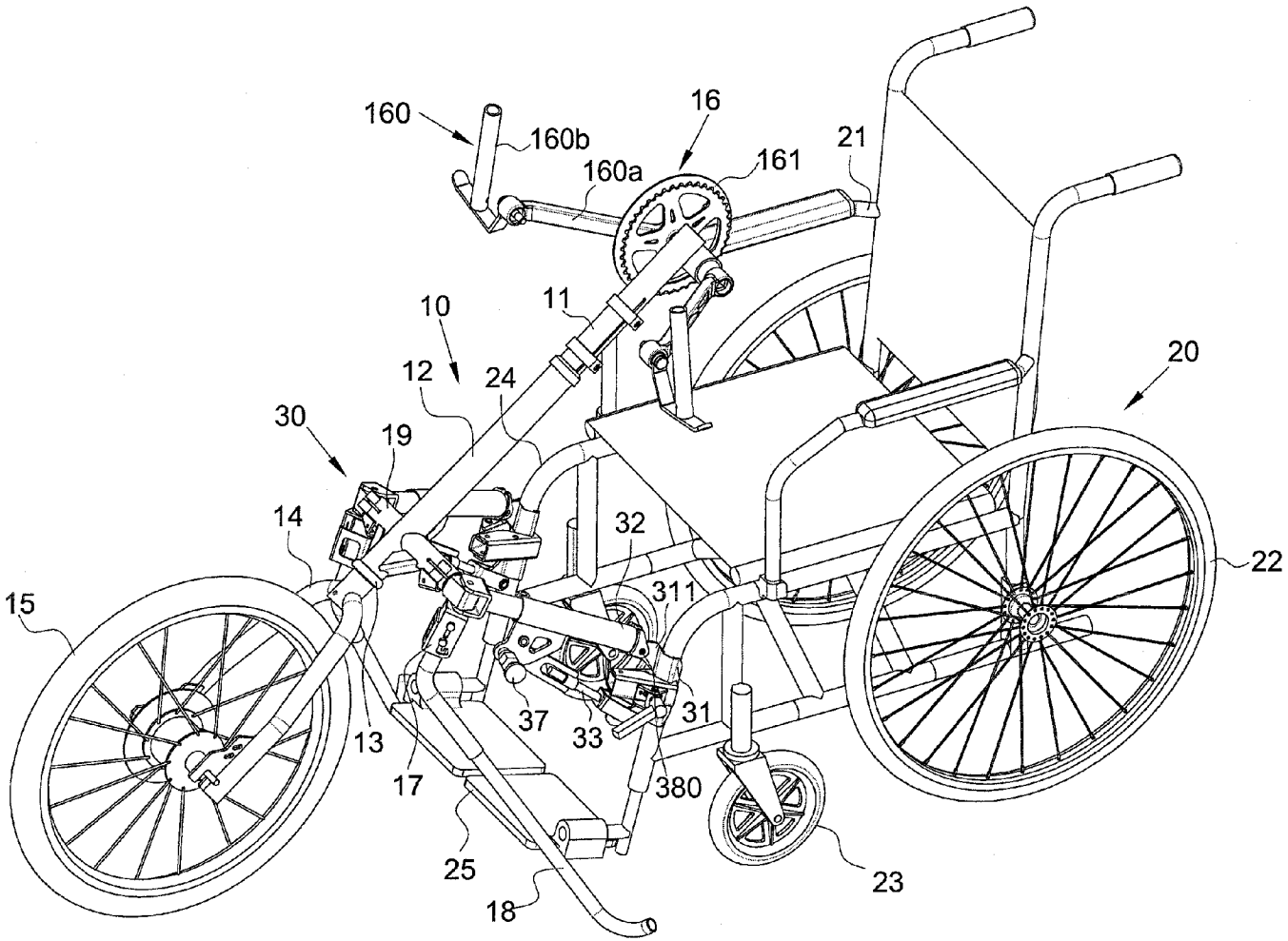
FIG. 4 is a perspective view to show that the tractor assembly is connected to the wheel chair.

As shown in FIGS. 1 to 3, the preferable embodiment of the tractor 10 has a steerer tube 11, a head tube 12, a headset 13, a front fork 14, a wheel 15 and a driving unit 16. The driving unit 16 is connected to the top of the steerer tube 11, the lower end of the steerer tube 11 is rotatably connected to the top of the head tube 12 by the headset 13. The lower end of the head tube 12 is rotatably connected to the front fork 14 by the headset 13. The lower end of the front fork 14 is pivotably connected to the axle of the wheel 15. The driving unit 16 has a crank unit 160 and a transmission unit 161, wherein the crank unit 160 has a crank 160*a* and a handle 160*b* connected to the crank 160*a*. The user holds the handle 160*b* to rotate the crank 160*a* to generate a force which is transmitted by the transmission unit 161 to drive the wheel 15.

The rear part 20 is a wheel chair in this embodiment, and which has a frame 21, two rear wheels 22 connected to the rear end of the frame 21, and two front wheels 23 connected to the front end of the frame 21. Two hanger brackets 24 are respectively connected to two sides of the front end of the frame 21, and each hanger bracket 24 has a footplate 25 connected to the lower end thereof. The two respective middle sections of the two hanger brackets 24 are secured by the securing portion 310 of the fixing member 31.

Figure 7:
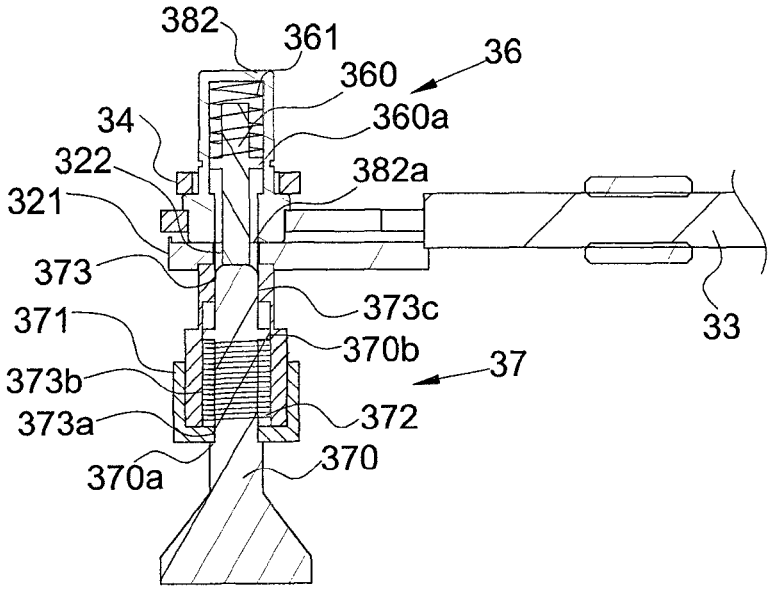
FIG. 7 shows that the reception hole is exposed and the engaging unit is positioned.
Figure 8:
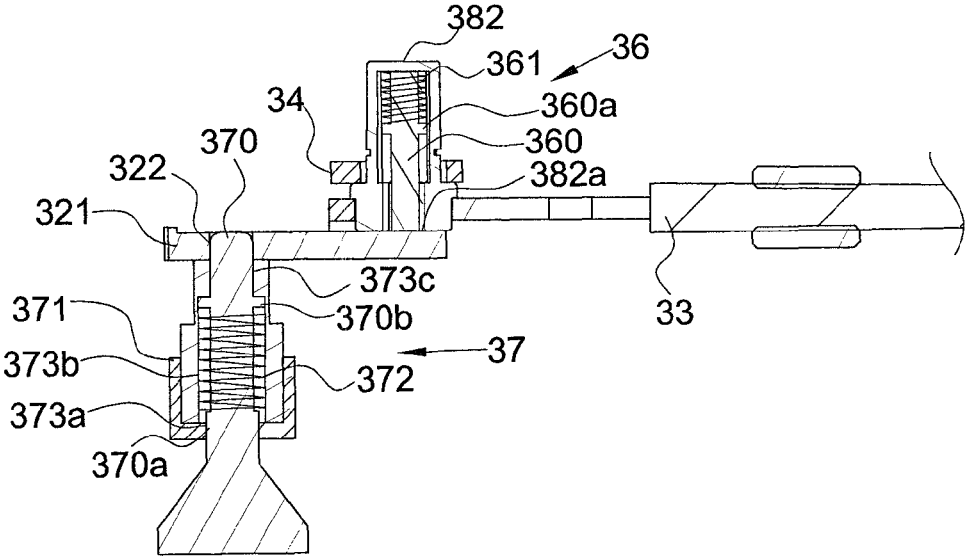
FIG. 8 shows that the reception hole is sealed.

As shown in FIGS. 7 and 8, the fourth pivot 382 is a tubular member and has one closed end, and a through hole 382*a* is defined in the other end of the fourth pivot 382. The engaging unit 36 has a second resilient member 361. The engaging section 360 has a first flange 360*a* extending outward and radially from the middle portion thereof. The second resilient member 361 is biased between the first flange 360*a* and the inside of the closed end of the fourth pivot 382. The engaging section 360 extends through the first through hole 382*a* and is engaged with the reception hole 322 by the force from the second resilient member 361 overcoming the resilient force of the third resilient member 372 as shown in FIG. 7.

The positioning unit 37 has a tube 371 in which the push rod 370 is movably located, and a third resilient member 372. The tube 371 has a second through hole 373 defined axially therethrough and the second through hole 373 communicates with the reception hole 322. The second through hole 373 comprises a first hole 373*a*, a second hole 373*b* and a third hole 373*c*, the second hole 373*b* has the maximum diameter. The push rod 370 has a second flange 370*a* on one end thereof and the second flange 370*a* is engaged with the first hole 373*a*. The push rod 370 has a second flange 370*a* extending from the middle portion thereof and the second flange 370*a* is engaged with the second hole 373*b*. The third resilient member 372 is located between the second hole 373*b* and the third flange 370*b*. When the push rod 370 is located at the first position, the second flange 370*a* extends through the first hole 373*a*, the push rod 370 is pushed by the third resilient member 372 and inserted into the third hole 373*c* so as to seal the reception hole 322 as shown in FIG. 7. When the push rod 370 is located at the second position, the second flange 370*a* contacts an outside of the first hole 373*a* and the push rod 370 is retracted and the reception hole 322 is exposed as shown in FIG. 7.

Figure 5:
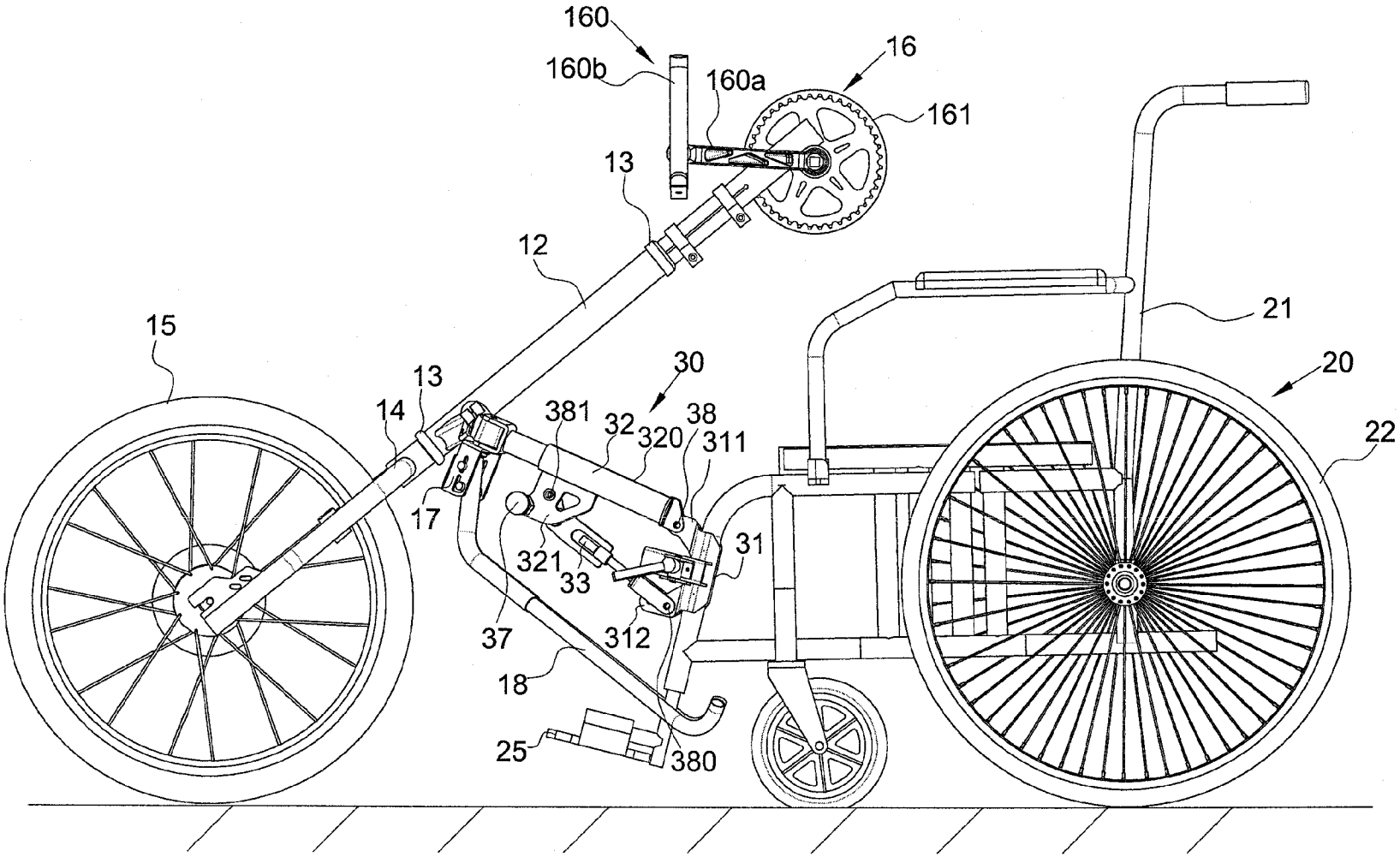
FIG. 5 is a side view to show that the front wheels of the wheel chair are in contact with the ground.

As shown in FIGS. 1 to 6, the connection unit 30 is connected between the tractor 10 and the rear part 20, two transverse bars 19 are connected to two sides of the tractor 10 and each transverse bar 19 has an adjustment unit 17 so as to support the rods 18 which are used as support legs. The connection unit 30 comprises the four-link mechanism formed by the fixing member 31, the top link unit 32, the bottom link unit 33 and the swing rod 34. The connection unit 30 further comprises the engaging unit 37 and the positioning unit 37. The engaging unit 36 has the engaging section 360 and the top link unit 32 has the reception hole 322. The positioning unit 37 has the push rod 370. When the four-link mechanism is activated to lift the front end of the rear part 20, the front wheels 23 are lifted from the ground as shown in FIG. 5. When the swing rod 34 swings about the third pivot 381 by a first angle relative to the top link unit 32, the engaging section 360 is located to be aligned with the reception hole 322. The engaging section 360 is pushed by the resilient force from the second resilient member 361 and inserted into the reception hole, so that the tractor 10, the rear part 20 and the connection unit 30 are integrally connected with each other. Each rod 18 has a straight section 180 and a bent section 181. The adjustment units 17 control the two rods 18 to be pivoted to a first angular position and a second angular position. When the two rods 18 are pivoted to the first angular position, two distal ends of the two bent sections 181 of the two rods 18 are folded and located above a ground as shown in FIG. 5. When the two rods 18 are pivoted to the second angular position, the two distal ends of the two bent sections 181 of the two rods 18 contact the ground as shown in FIG. 3.

Figure 9:
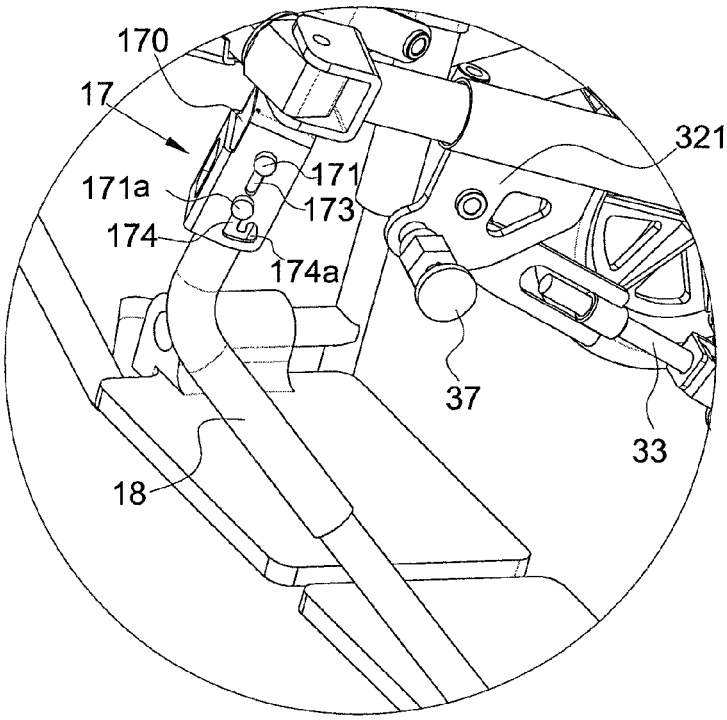
FIG. 9 shows the first status of the adjustment unit of the tractor assembly of the present invention.
Figure 10:
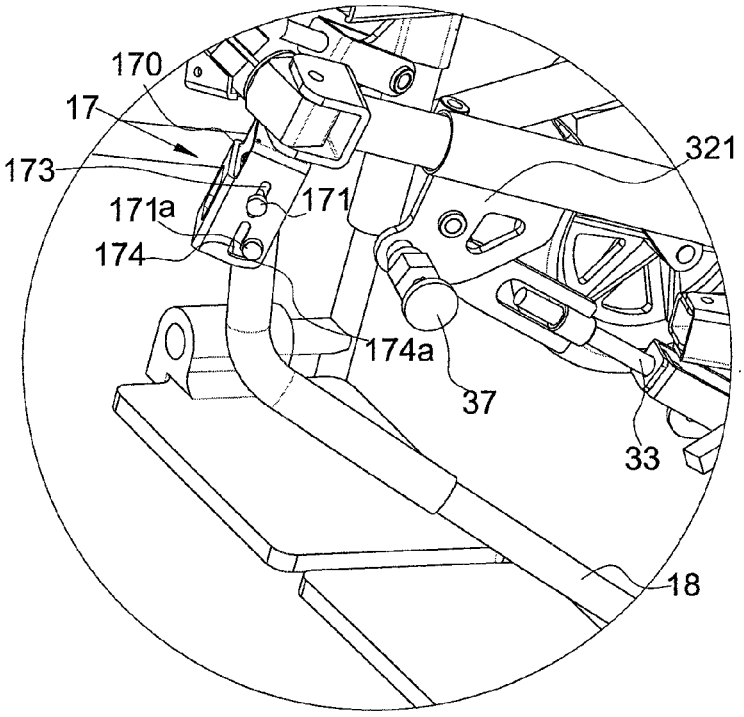
FIG. 10 shows the second status of the adjustment unit of the tractor assembly of the present invention.
Figure 11:
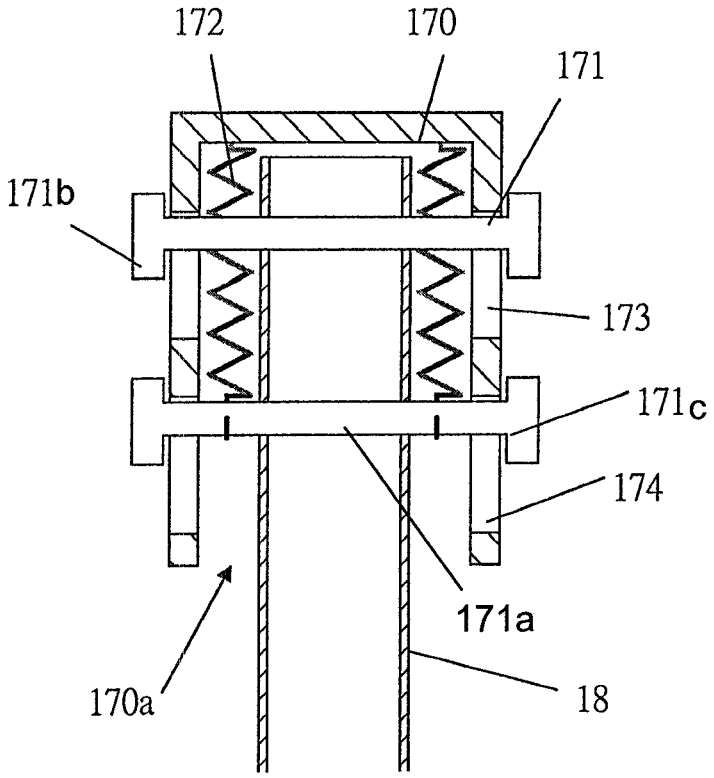
FIG. 11 shows the cross sectional view of the adjustment unit of the tractor assembly of the present invention.

As shown in FIGS. 9 to 11, the adjustment units 17 each have a sleeve 170, a first slide pin 171, a second slide pin 171*a* and at least one resilient member 172. The sleeve 170 has an opening 170*a* defined in at least one end thereof. Two sidewalls of the opening 170*a* each have a first slot 173. A second slot 174 is defined axially in each of the sidewalls and located beneath the first slot 173. An extension space 174*a* is angularly formed at the distal end of the second slot 174. The first and second slide pins 171, 171*a* are respectively fixed to the top of the rods 18. The sleeve 170 is connected to the top of the rod 18. The first and second slide pins 171, 171*a* extend through the first and second slots 173, 174 respectively. The at least one resilient member 172 is biased between an inner end of the sleeve 170 and the second slide pin 171*a* so as to provide a pull force to the rod 18 relative to the sleeve 170. When the first and second slide pins 171, 171*a* are located at two respective top ends of the first and second slots 173, 174, the two rods 18 are located at the first angular position. When the first slide pin 171 is located at the middle portion of the first slot 173 and the second slide pin 171*a* is located the distal end of the extension space 174*a* of the second slot 174, the two rods 18 are located at the second angular position by the force from the at least one resilient member 172. As shown in FIG. 11, each of the first and second slide pins 171, 171*a* has an enlarged section 171*b*/171*c*, the two enlarged sections 171*b*, 171*c* respectively contact the outside of the first slot 173 or the second slot 174.

Figure 6:
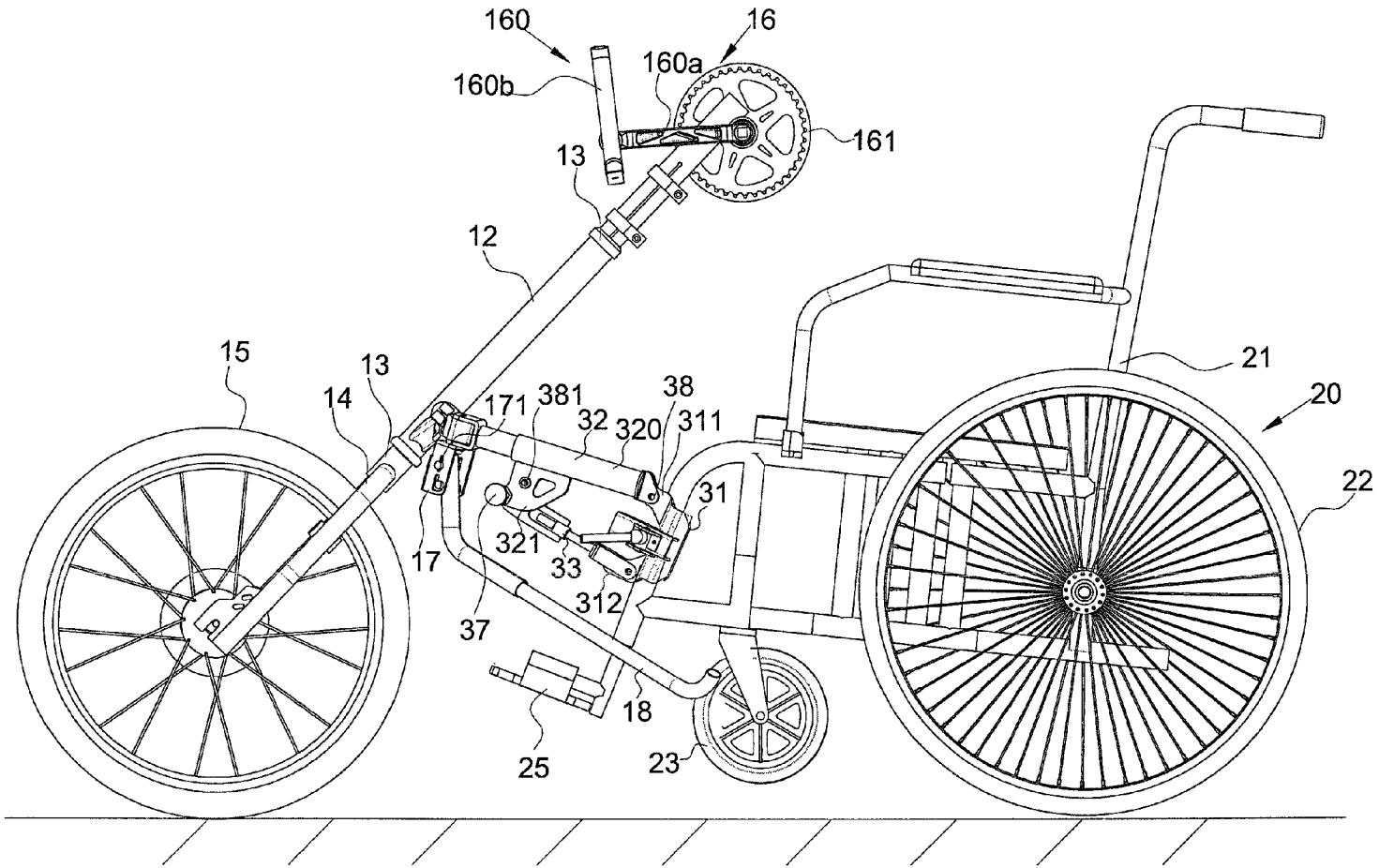
FIG. 6 is a side view to show that the front wheels of the wheel chair are lifted and located above the ground.

When the user wants to assemble the tractor 10 and the rear part 20, the rear part 20 is moved toward the tractor 10 as shown in FIG. 3, and the lever 313 is operated to secure the securing portion 310 to the rear part 20. The user then pushes the top of the tractor 10 to lift the front wheels 23 upward to the first angular position by the use of the four-link mechanism, the engaging section 360 is engaged with the reception hole 322 by the second resilient member 361. The rod 18 is pulled downward relative to the sleeve 170 to move the second slide pin 171*a* to the bottom end of the second slot 174, the rod 18 is then bent relative to the sleeve 170 to allow the second slide pin 171*a* to be engaged with the extension space 174*a* to be positioned. By the force from the resilient member 172, the rod 18 is secured at the angular position as shown in FIG. 6.

When the user wants to separate the tractor 10 and the rear part 20, the two rods 18 are adjusted to upright status by rotating the two rods 18 clockwise as shown in FIGS. 9-11.

The two ends of the resilient member 172 are connected to the sleeve 170 and the second slide pin 171*a*, so that when the second slide pin 171*a* removes from the extension space 174*a* of the second slot 174, by using the force of the resilient member 172, the first and second slide pins 171, 171*a* quickly move to the top ends of the first and second slots 173, 174. Therefore, the two rods 18 are located at the first angular position (upright) as shown in FIG. 3. The push rod 370 is then pushed to remove the engaging section 360 from the reception hole 322. The user uses the weight of the frame and his/her body weight to drive the four-link mechanism reversely to move the front end of the rear part 20 downward to let the front wheels 23 contact the ground. The lever 313 is then operated to release the securing portion 310 from the rear part 20, so that the tractor 10 is separated from the rear part 20.

The present invention allows the user to connect the tractor 10 to the wheel chair or to separate the tractor 10 from the wheel chair easily, without adding any extra connection device.

The tractor 10 has angle adjustable support legs to adjust the tractor 10 upright so that the tractor 10 is easily connected to or separated from the wheel chair. The support legs can be folded when the user operates the tractor 10 to move the wheel chair.

While we have shown and described the embodiment in accordance with the present invention, it should be clear to those skilled in the art that further embodiments may be made without departing from the scope of the present invention.

What is claimed is:

1. A tractor assembly comprising:

a tractor;

a rear part;

a connection unit which is connected between the tractor and the rear part, the connection unit having a fixing member whose middle section is fixed to a front end of the rear part, the fixing member having a first pivotal portion and a second pivotal portion which is located below the first pivotal portion;

a top link unit having a first end pivotably connected to the first pivotal portion, a second end of the top link unit connected to the tractor, the top link unit having a reception hole;

a bottom link unit having a first pivotably connected to the second pivotal portion by a second pivot extending therethrough;

a swing rod having a first end pivotably connected to the top link unit by a third pivot, a second end of the swing rod pivotably connected to a second end of the bottom link unit by a fourth pivot so that the swing rod, the fixing member, the top link unit and the bottom link unit form a four-link mechanism;

an engaging unit having an engaging section and a second resilient member which provides a resilient force to the engaging section, and a positioning unit located on an outside of a connection plate of the top link unit and having a push rod, when the swing rod swings about the third pivot by a first angle relative to the top link unit, the front end of the rear part lifts up and the engaging section and the push rod are located to be aligned with the reception hole, the engaging section is pushed by the resilient force from the second resilient member and inserted into the reception hole, the push rod is able to push the engaging section out from the reception hole.

2. The tractor assembly as claimed in claim 1, wherein the tractor has a driving unit, a steerer tube, a head tube, a front fork and a wheel, the driving unit is connected to a top of the steerer tube, a lower end of the steerer tube is rotatably connected to a top of the head tube by a headset, a lower end of the head tube is rotatably connected to the front fork by the headset, a lower end of the front fork is pivotably connected to an axle of the wheel.

3. The tractor assembly as claimed in claim 2, wherein the driving unit has a crank unit and a transmission unit, the crank unit has a crank and a handle connected to the crank, the handle and the crank are rotated to generate a force which is transmitted by the transmission unit to drive the wheel.

4. The tractor assembly as claimed in claim 1, wherein the rear part is a wheel chair which has a frame, two rear wheels connected to a rear end of the frame and two front wheels connected to a front end of the frame, two hanger brackets are respectively connected to two sides of the front end of the frame, and each hanger bracket has a footplate connected to a lower end thereof, the two respective middle sections of the two hanger brackets are secured by a securing portion of the fixing member.

5. The tractor assembly as claimed in claim 1, wherein two adjustment units are connected to two sides of the tractor, two rods are connected to the two adjustment units respectively, each rod has a straight section and a bent section, the adjustment units control the two rods to be pivoted to a first angular position and a second angular position, when the two rods are pivoted to the first angular position, two distal ends of the two bent sections of the two rods are folded and located above a ground, when the two rods are pivoted to the second angular position, the two distal ends of the two bent sections of the two rods contact the ground.

6. The tractor assembly as claimed in claim 5, wherein the adjustment units each have a sleeve, a first slide pin, a second slide pin and at least one resilient member, the sleeve has an opening defined in at least one end thereof, two sidewalls of the opening each have a first slot, a second slot is defined axially in each of the sidewalls and located beneath the first slot, an extension space is angularly formed at a distal end of the second slot, the first slide pin extends through first slots and the rod, the second slide pin transversely extends through the two second slots and the rod, the at least one resilient member is biased between an inner end of the sleeve and the second slide pin, when the first and second slide pins are located at two respective top ends of the first and second slots, the two rods are located at the first angular position, when the first slide pin is located at the middle portion of the first slot and the second slide pin is located a distal end of the extension space of the second slot, the two rods are located at the second angular position.

7. The tractor assembly as claimed in claim 6, wherein the first and second slide pins each have an enlarged section on two ends thereof, the two enlarged sections are exposed and in contact with an outside of the first slot or the second slot.

8. The tractor assembly as claimed in claim 1, wherein the fourth pivot is a tubular member and has one closed end, a through hole is defined in the other end of the fourth pivot, the engaging unit has the second resilient member, the engaging section has a first flange extending outward and radially from a middle portion thereof, the second resilient member is biased between the first flange and an inside of the closed end of the fourth pivot, the engaging section extends through the first through hole and is engaged with the reception hole by a force from the second resilient member.

9. The tractor assembly as claimed in claim 1, wherein the positioning unit has a tube in which the push rod is movably located, and a third resilient member, the tube has a second through hole defined axially therethrough and the second through hole communicates with the reception hole, the second through hole comprises a first hole, a second hole and a third hole, the second hole has the maximum diameter, the push rod has a second flange on one end thereof and the second flange is engaged with the first hole, the push rod has a second flange extending from a middle portion thereof and the second flange is engaged with the second hole, the third resilient member is located between the second hole and the third flange, when the push rod is located at the first position, the second flange extends through the first hole, the push rod is pushed by the third resilient member and inserted into the third hole so as to seal the reception hole, when the push rod is located at the second position, the second flange contacts an outside of the first hole and the push rod is retracted and the reception hole is exposed.

10. The tractor assembly as claimed in claim 1, wherein the top link unit has a top link and the connection plate which is located close to a first end of the top link, a second end of the top link is pivotably connected to the first pivotal portion by a first pivot, the first end of the top link is connected to the tractor, the reception hole and the third pivot are connected to the connection plate.

* * * * *